United States Patent [19]

Mantel

[11] Patent Number: 4,573,392

[45] Date of Patent: Mar. 4, 1986

[54] IN-LINE BULLET FEEDER

[75] Inventor: Robert W. Mantel, Sussex, Wis.

[73] Assignee: Mantel Machine Products, Inc., Menomonee Falls, Wis.

[21] Appl. No.: 648,719

[22] Filed: Sep. 10, 1984

[51] Int. Cl.[4] ..... F42B 11/02

[52] U.S. Cl. ..... 86/43; 86/44; 86/45

[58] Field of Search ..... 86/43, 44, 45, 46, 25, 86/26, 27, 40, 23, 31; 269/37

[56] References Cited

U.S. PATENT DOCUMENTS

| | | | |
|---|---|---|---|
| 620,350 | 2/1899 | McGrail | 86/45 |
| 3,336,830 | 8/1967 | Lester, Jr. | 86/45 |
| 3,580,127 | 5/1971 | Lee | 86/43 |
| 3,602,084 | 8/1971 | Corcoran | 86/45 |
| 3,610,090 | 10/1971 | Corcoran | 86/45 |
| 3,916,758 | 11/1975 | Ashbrook | 86/44 |
| 4,425,833 | 1/1984 | Purdie | 86/44 |
| 4,475,435 | 10/1984 | Mantel | 86/45 |

*Primary Examiner*—Stephen J. Lechert, Jr.
*Assistant Examiner*—Howard J. Locker
*Attorney, Agent, or Firm*—Ronald E. Barry

[57] ABSTRACT

An in-line bullet feeder including a tubular member having a passage forming a path of travel through the member, a first bullet stop assembly formed by three balls positioned at equally spaced positions around the passage, the balls being biased inwardly by a resilient ring and a second bullet stop assembly formed by three balls positioned above the first stop assembly a spaced distance at equally spaced positions around the passage, the balls of the second stop assembly being retained in the passage by a tubular member having a camming surface and a retaining flange for selectively locking the balls in the passage, the first stop assembly being cammed out of the passage by the open end of the shell case as it enters the passage and the second stop assembly preventing upward movement of the bullet to seat the bullet in the casing.

14 Claims, 4 Drawing Figures

IN-LINE BULLET FEEDER

BACKGROUND OF THE INVENTION

An in-line bullet feeder of the type contemplated herein is shown in my co-pending application, Ser. No. 469,731, entitled "In Line Bullet Feed Assembly," filed on Feb. 25, 1983 now U.S. Pat. No. 4,475,435 issued on Oct. 9, 1984. This assembly is designed to automatically feed bullets to a shell casing and to seat the bullet in the shell casing. The bullets in the in-line feeder were held in position by two sets of specially designed dogs pivotally mounted in the housing.

SUMMARY OF THE INVENTION

The in-line bullet feeder of the present invention functions in substantially the same way as the bullet feed assembly disclosed in my earlier application, but is simpler in construction and more efficient in operation. The bullets are held in position by ball assemblies which require no special machining and provide a simple camming function. The balls provide a more reliable operation by supporting the bullets at three equally spaced points.

IN THE DRAWINGS

DESCRIPTION OF THE INVENTION

Figure 2:
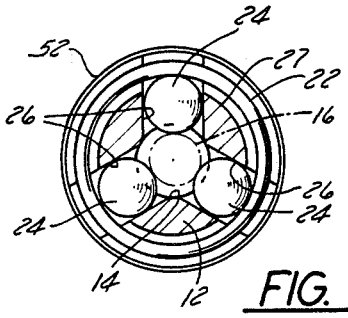
FIG. 2 is a view taken on line 2—2 of FIG. 1.

The in-line bullet feed assembly 10 of the type contemplated herein is similar to the bullet feed assembly disclosed in my earlier filed application Ser. No. 469,731, filed Feb. 25, 1983, and entitled, "In-Line Bullet Feed Assembly". As disclosed therein, the bullet feed assembly is used on shell reloaders of either the manual or automatic type. The bullet feed assembly can be used in a progressive shell reloader as disclosed in my earlier application and functions in substantially the same way as the in-line feeder disclosed therein.

The bullet feed assembly 10, as shown in FIGS. 1–4, includes a base member or housing 12 having a bullet feed passage 14 and a bullet reservoir (not shown) mounted on the upper end of the housing 12 to automatically feed bullets 16 into the passage 14. The bullets 16 normally drop by gravity through the passage 14 and are caught by means of a first ball assembly 18. The bottom bullet 16 is isolated from the other bullets in the feed passage 14 by means of a second ball assembly 20 located a spaced distance above the ball assembly 18 slightly less than the length of a bullet 16. The bottom bullet 16 is released from the ball assembly 18 by the movement of the housing downward with respect to a shell or casing 15 which enters the lower end of passage 14 to displace or cam the ball assembly 18 radially outward.

In this regard, it should be noted that the lower ball assembly 18 includes a number of balls 24, in this case 3, located in equally spaced ports 26 provided in the housing 12. The balls are biased inward by means of a spring 22 in the form of a resilient O-ring positioned in a groove 27 provided in the outer wall of the housing 12. The balls 24 will normally be located in a position to block the downward movement of the bullets 16.

Figure 1:
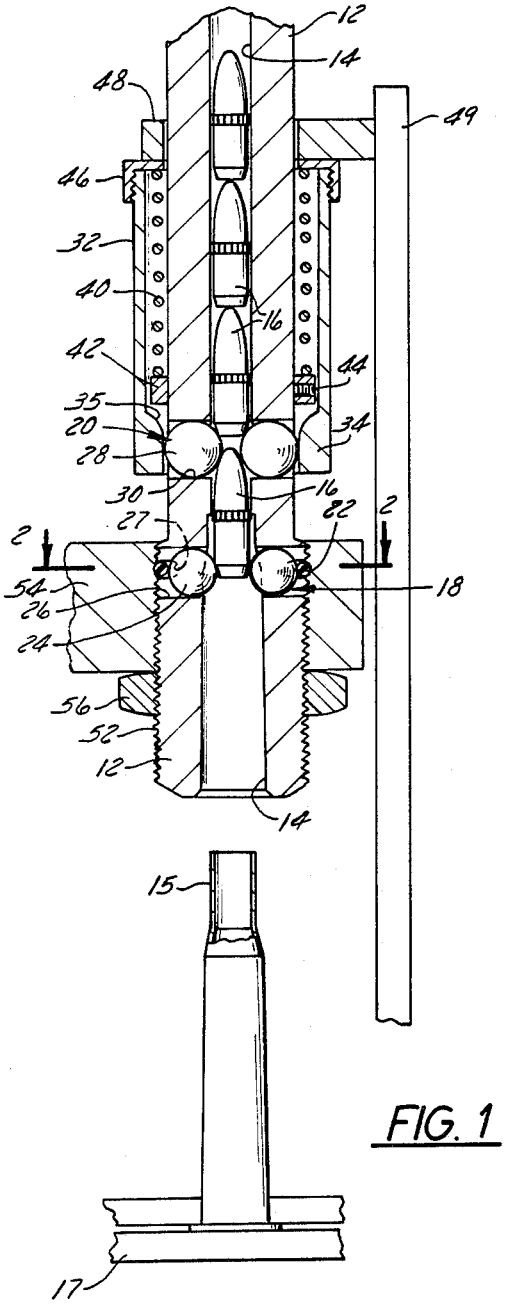
FIG. 1 is a side elevation view in section showing a shell casing in position to be pushed into the bullet housing.
Figure 3:
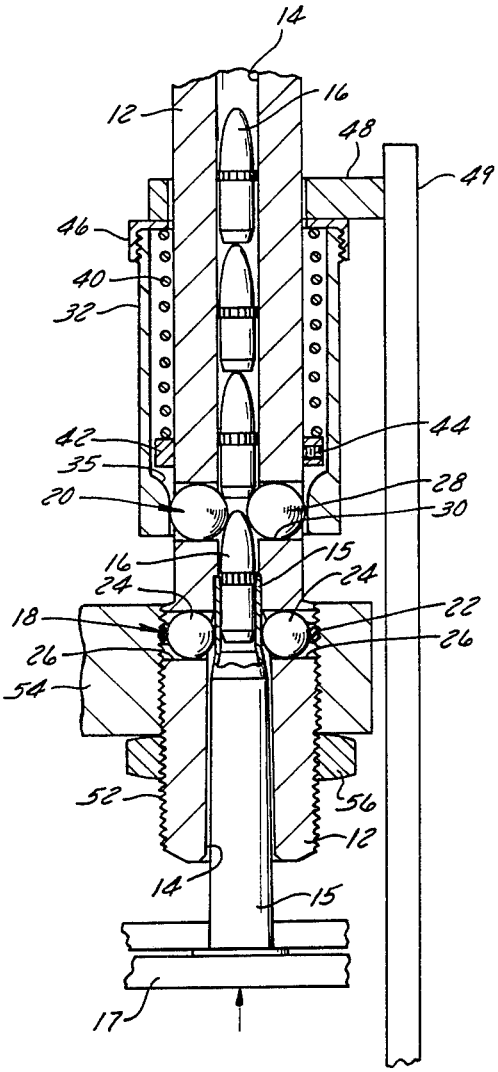
FIG. 3 is a view similar to FIG. 1 showing the bullet seated in the shell casing.
Figure 4:
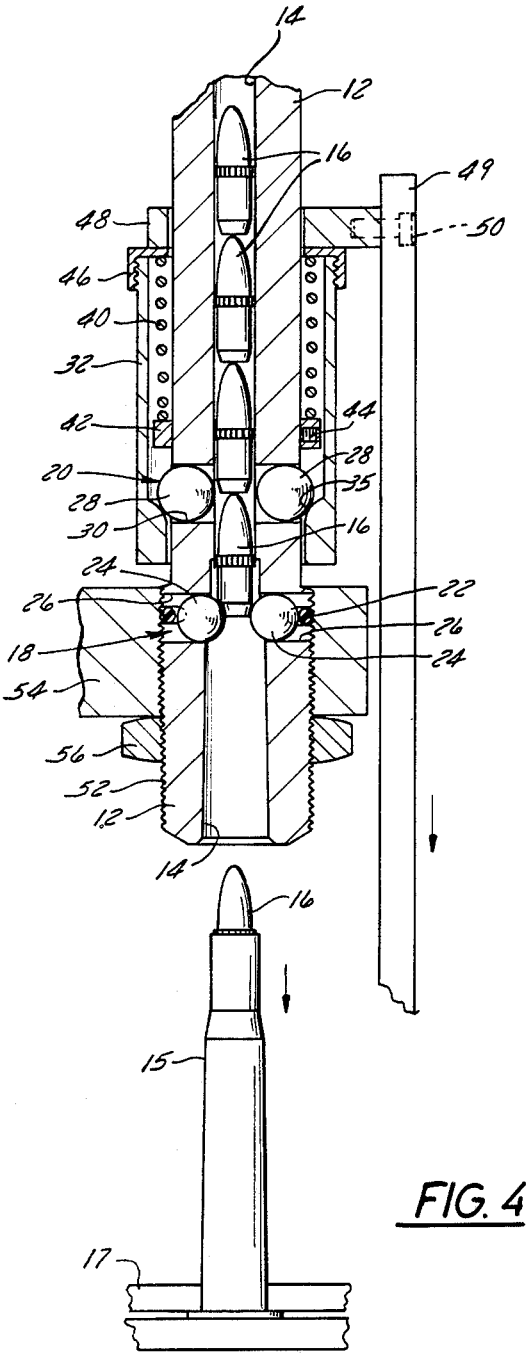
FIG. 4 is a view similar to FIG. 1 showing the bullets in the passage released for movement to the bottom of the passage.

This can be seen in FIG. 1 wherein the ball assembly 18, is shown biased to a blocking position in passage 14. In FIG. 3, the balls are shown cammed out of the passage 14 by the engagement of the upper end of casing 15 which has entered the lower portion of the passage 14. The upper end of the casing 15 will engage the balls 24 camming them outward against the bias of the spring 22.

The bullet 16 is prevented from moving upward by means of the second ball assembly 20 which also includes a second set of balls 28 which are located in ports 30. The balls are located at three equally spaced positions. The second set of balls 28 are forced inward by means of a cup 32 as shown in FIG. 1. The balls 28 project partly into the passage 14 to prevent a bullet from passing through the passage 14. The cup 32 includes a lower flange 34 having a cam surface 35. The flange 34 holds the balls 28 radially inward into the path of the bullets 16 in passage 14. The balls 28 are released for outward movement in the ports 30 by the downward motion of the cup 32. This can be seen in FIG. 4 where the balls 28 are shown above the flange 34. The balls 28 are moved outward by the weight of the bullets 16 in passage 14. This allows the bullets 16 to drop down onto the ball assembly 18.

The cup 32 is biased upward by means of a spring 40 which rests on a ring 42 secured to the housing 12 by means of a set screw 44. The spring 40 acts against a cap 46 secured to the upper end of the cup 32. The cap 46 will engage ring 48 which is secured to a rod 49 by means of a set screw 50. The rod 49 is mounted on the platen 17 for movement relative to the housing 12.

The housing 12 includes a threaded section 52 at the lower end of which is threaded into the platen 54 for an in-line bullet feeder. The housing is locked thereon by means of a nut 56. It should be noted that the platen 17 moves up and down with respect to the platen 54. On the upward motion of the platen 17, the shell casing 15 will enter the lower end of the passage 14 and engage the balls 24. The balls will be cammed outward against the bias of the O-ring 22 as the shell casing engages the lower portion of the bullet 16. The bullet 16 is seated in the shell casing by means of the ball assembly 20. In this regard, it should be noted that the balls 28 are locked in the ports 30 by the flange 34. As the shell casing moves upward, the bullet 16 cannot move upward and is forced into the open end of the casing. Once the bullet is fully seated in the shell casing it will be pulled out of the passage by the downward motion of shell casing.

The platen 17 is then moved downward to draw the shell casing and the bullet 16 out of the passage 14 in housing 12. Near the end of the downward motion of the platen 17, the ring 48 on rod 49 will engage the cap 46 on cup 32, pushing the cup 32 downward. The spring 40 will be compressed between ring 48 and ring 44. As the flange 24 moves downward, the balls 28 will be free to move outward. The balls will be cammed outward by the weight of the bullets 16 in the passage 14 which are supported in the passage by the balls 28. Once the balls have moved outward in the ports 30, the bullets 16 will drop downward unto the balls 24 in the ball assembly 18. The O-ring 22 must have sufficient bias to support the weight of all of the bullets in the passage 14. When the motion of the platen 17 is again reversed to move upward to seat the next bullet in the top of the next shell casing, the spring 40 will push the cup 32 upward and the curved surface 35 on flange 34 will cam the balls 28 back into the ports 30 to prevent the next bullet 16 from dropping down in the passage 14.

The embodiments of the invention in which an exclusive property or privilege is claimed, are defined as follows:

1. In an in-line bullet feeder of the type used for seating a bullet in the open end of a shell case, said feeder including a housing, a passage through the housing, and a gravity feed bullet reservoir connected to one end of the passage, the improvement comprising a first ball assembly mounted in the housing in a position to prevent bullets from dropping through the passage, a second ball assembly mounted in the housing spaced upwardly from the first ball assembly in a position to prevent bullets from moving up or down in the passage, and cup means mounted on the housing for holding the second ball assembly in the blocking position in the passage, and means for moving said cup means away from said second ball assembly whereby a bullet resting on said second ball assembly will cam the second ball assembly outwardly from the passage to allow the bullet to move downward to a position resting on the first ball assembly in the passage.

2. The bullet feeder according to claim 1 wherein the first ball assembly is moved outwardly on insertion of a shell casing in the passage to release the bullet from the first ball assembly.

3. The bullet feeder according to claim 2 wherein the first ball assembly includes three balls mounted for movement into and out of the path of motion of a bullet dropping through the passage.

4. The bullet feeder according to claim 3 including means for biasing the balls radially inwardly.

5. The bullet feeder according to claim 4 wherein said biasing means comprises a resilient ring mounted on the outer periphery of said balls.

6. The feeder according to claim 1 wherein said second ball assembly includes three balls mounted for movement into and out of the path of motion of a bullet dropping through the passage.

7. The feeder according to claim 6 wherein said cup means includes a cup mounted on said housing and having a flange for holding said balls in said second ball assembly in the path of motion in said passage, said cup being movable relative to the second ball assembly to release the balls for movement out of the path of motion of the bullets through the passage.

8. The feeder according to claim 3 including a resilient ring encircling said three balls whereby said balls are biased to the blocking position.

9. The feeder according to claim 3 or 8 wherein said second ball assembly includes three balls mounted for movement into and out of the path of motion of a bullet through the passage.

10. A bullet feeder comprising a tubular housing having a generally vertical passage, first means positioned at the lower end of said housing for preventing the passage of bullets through said passage, said first means including a number of balls positioned for movement into the passage, said balls being movable outwardly on engagement with the open end of a shell case to clear the passage to allow a bullet to move past the said first means and second means positioned in said housing in a spaced relation to said first means for preventing upward movement of a bullet supported on said first means when engaged by a shell case whereby said bullet will be seated in the shell case.

11. The feeder according to claim 10 wherein said second means includes a number of balls positioned for movement into said passage, and a tubular member mounted for axial movement on said housing to prevent said balls in said second means from moving out of said passage on engagement by the bullets in said passage.

12. The feeder according to claims 10 or 11 wherein said first means includes resilient means for biasing said balls of said first means to a blocking positions.

13. The feeder according to claims 10 or 11 wherein said first means includes three balls located at three equally spaced positions in said housing.

14. The feeder according to claim 12 wherein said resilient means comprises a resilient ring encircling said balls.

* * * * *